US008698695B2

(12) United States Patent
Wyckoff et al.

(10) Patent No.: US 8,698,695 B2
(45) Date of Patent: Apr. 15, 2014

(54) ANTENNA SYSTEM FOR USE IN AGRICULTURAL FIELDS OR OTHER WORK AREAS

(75) Inventors: Jan M. Wyckoff, Sycamore, IL (US); Vickie L. Ellis, Milan, IL (US); Christopher A. Trapkus, Moline, IL (US)

(73) Assignee: Deere & Company, Moline, IL (US)

( * ) Notice: Subject to any disclaimer, the term of this patent is extended or adjusted under 35 U.S.C. 154(b) by 270 days.

(21) Appl. No.: 13/192,787

(22) Filed: Jul. 28, 2011

(65) Prior Publication Data

US 2013/0027265 A1 Jan. 31, 2013

(51) Int. Cl.
*H01Q 1/12* (2006.01)

(52) U.S. Cl.
USPC ..... 343/890; 343/878

(58) Field of Classification Search
USPC ..... 343/890, 878
See application file for complete search history.

(56) References Cited

U.S. PATENT DOCUMENTS

| | | | | |
|---|---|---|---|---|
| 2,546,026 | A | 3/1951 | Coon | |
| 4,161,723 | A * | 7/1979 | De Vittori | 340/323 R |
| 4,642,650 | A | 2/1987 | Morton | |
| 4,697,779 | A | 10/1987 | Guislain | |
| 4,744,381 | A | 5/1988 | Pritchett | |
| 5,626,418 | A * | 5/1997 | Angelis et al. | 362/390 |
| 5,929,807 | A * | 7/1999 | Viney et al. | 342/357.32 |
| 6,772,526 | B1 * | 8/2004 | Crain et al. | 33/296 |
| 7,032,811 | B1 * | 4/2006 | Paulic et al. | 232/39 |
| 7,562,487 | B2 * | 7/2009 | Barr | 43/2 |
| 2009/0024325 | A1 * | 1/2009 | Scherzinger | 702/5 |
| 2010/0197222 | A1 | 8/2010 | Scheucher | |

FOREIGN PATENT DOCUMENTS

| | | | |
|---|---|---|---|
| CH | 553485 | A | 8/1974 |
| DE | 2601229 | C2 | 5/1979 |
| EP | 2551953 | A1 | 1/2013 |
| WO | 2007005138 | | 1/2007 |

* cited by examiner

*Primary Examiner* — Hoang V Nguyen

(57) ABSTRACT

An antenna system for use in an agricultural field or work area comprises a base having an upper side and a lower side opposite the upper side. A stake extends from the lower side. The stake is capable of mounting into the ground. A spring extends from the upper side of the base. A mast above the base is movably, resiliently mounted to the base by the spring. A lateral dielectric guard is mounted at or the near a top of the mast. An antenna is associated with the top of the mast, the antenna coupled to a transmission line that is secured to or by the mast.

12 Claims, 2 Drawing Sheets

ANTENNA SYSTEM FOR USE IN AGRICULTURAL FIELDS OR OTHER WORK AREAS

FIELD OF THE INVENTION

This invention relates to an antenna system for use in agricultural fields or other work areas.

BACKGROUND OF THE INVENTION

Certain wireless systems (e.g., wireless soil sensor systems) used for agricultural fields may use radio frequency or microwave antennas mounted lower than an average crop height or crop canopy. One reason for mounting the antennas lower than the average crop height or crop canopy is to avoid damage from sprayers or other agricultural equipment that perform operations in the field. Because certain prior art antennas are mounted lower than the average crop height or crop canopy and are susceptible to attenuation from terrain, crops, and other vegetation, the propagation of wireless signals may be unreliable between one or more communication devices in the field and a central or remote location (e.g., farmer's office computer system). Thus, there is a need for an antenna system that increases the reliability of wireless signal propagation for agricultural fields and other work areas.

SUMMARY OF THE INVENTION

In one embodiment, an antenna system for use in an agricultural field or work area comprises a base having an upper side and a lower side opposite the upper side. A stake extends from the lower side. The stake is capable of mounting into the ground. A spring extends from the upper side of the base. A mast above the base is resiliently, movably mounted to the base by the spring. A lateral dielectric guard is mounted at or the near a top of the mast. An antenna is associated with the top of the mast, the antenna coupled to a transmission line that is secured to or by the mast.

DESCRIPTION OF THE PREFERRED EMBODIMENT

Figure 1:
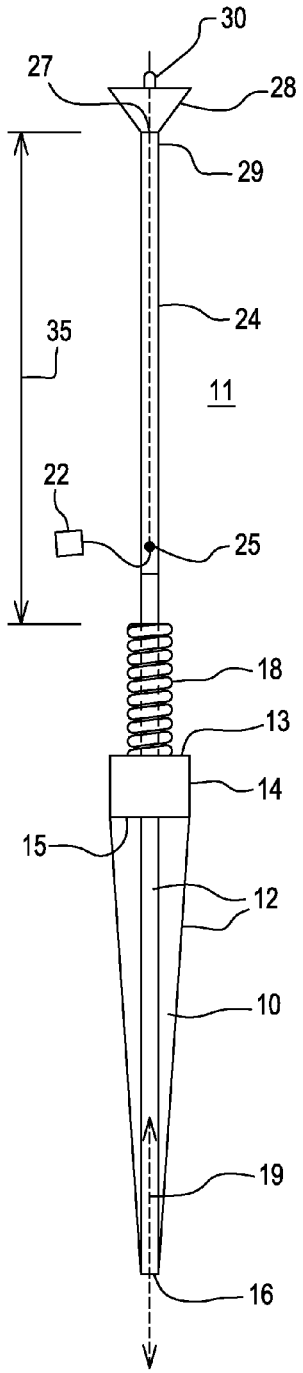
FIG. 1 illustrates a side view of one embodiment of an antenna system in accordance with the invention.

FIG. 1 illustrates one embodiment of an antenna system 11 for use in an agricultural field or another outdoor work area. The antenna system 11 may be used in agricultural fields and other outdoor work areas, such as construction sites, forestry harvesting sites, turf monitoring sites, garden monitoring sites, open-pit mines, underground water-well monitoring sites, surface water monitoring sites, and oil-well monitoring sites, and weather station sites, among other possibilities. For example, the antenna system 11 may be used for one or more weather stations or soil sensing stations within an agricultural field that report wirelessly to a central or master station.

The antenna system 11 comprises a base 14 having an upper side 13 and a lower side 15 opposite the upper side 13. A stake 10 extends from the lower side 15. The stake 10 is capable of mounting into ground. A spring 18 extends from or above the upper side 13 of the base 14. A mast 24 above the base 14 is movably mounted to the base 14 by the spring 18. A lateral dielectric guard 28 is mounted at or the near a top of the mast 24. An antenna 30 is associated with the top 29 of the mast 24. The antenna 30 is coupled to a transmission line 20 that is secured to the interior or exterior of the mast 24.

The base 14 may be generally rectangular, cylindrical or polyhedral, or shaped in other ways. A lower side 15 of the base 14 may form a stop that engages the ground when the stake 10 is placed into the ground by a maximum amount. A lower portion of the spring 18 may be cast, molded or otherwise secured to the base 14. The base 14 may be constructed from metal, an alloy, a plastic, a polymer, a composite material, a resin matrix with a filler, a fiber-filled plastic, or a fiber-filled polymer, for example. The fiber may comprise carbon fiber, fiber glass or another suitable filler.

In one configuration, the stake 10 comprises a blade 12 extending radially from a central vertical axis 19 of the stake 10, where the blade 12 is tapered radially inward toward a bottom of the stake 10. The bottom of the stake 10 may terminate in a point 16 or spear-shaped member. In another configuration, the stake 10 comprises a plurality blades 12 extending orthogonally and radially from a central vertical axis 19 of the stake 10, where the blades 12 are tapered radially inward toward a bottom (or point 16) of the stake 10.

The spring 18 may comprise a helical or coil spring 18 that is constructed of steel, spring steel, or another suitable alloy. In one embodiment, the spring 18 is selected to have a lateral resilience and vertical resilience, or a first equivalent spring constant, that supports the mass of the antenna mast 24, the dielectric guard (e.g., 28, 128 or 228), and the antenna (e.g., 30 or 130) when no external force is applied to the dielectric guard (28) or mast 24. In another embodiment, the spring 18 is selected to have a lateral resilience and vertical resilience, or a second equivalent spring constant, that supports the mass of the mast 24, the dielectric guard, and the antenna plus wind-loading of a certain maximum wind speed (e.g., 25 miles per hour (40.2 kilometers per hour)) or wind speed range (e.g., 25 miles per hour to 50 miles per hour (80.5 kilometers per hour)) to avoid permanent deformation of the spring 18, as opposed to elastic or resilient deformation. In another embodiment, the spring 18 is selected to have a lateral resilience and vertical resilience, or a third equivalent spring constant, that supports the mass of the antenna mast, dielectric guard and antenna plus ice-loading of a certain maximum thickness of ice (e.g., one-half inch (1.3 centimeters) to one inch of ice (2.54 centimeters)) on the mast and dielectric guard (e.g., 28, 128 or 228) to avoid permanent deformation of spring 18, as opposed to elastic or resilient deformation, where the antenna system (11, 111, or 211) is left in the field year round or during inclement weather.

In an alternate embodiment, the spring 18 is disposed above the upper side 13 to interconnect two longitudinal sections of an alternate mast.

In one configuration, mast 24 has a length or mast height 35 that is equal to or greater than the average crop height or the maximum crop height of a particular crop in the field. In another configuration, the mast 24 has a mast height 35 of approximately 5 to 7 feet (approximately 1.52 meters to 2.13 meters) for corn or maize, and a mast height 35 of approximately 2 to 4 feet (approximately 0.61 to 0.122 meters) for soybeans.

The mast 24 comprises a longitudinal member, a cylindrical member, a flexible member, a semi-rigid member, or a rod, for example. The mast 24 may be composed of a polymer, a plastic, a resin, a resin matrix with a filler, a fiber-filled polymer, a fiber-filled plastic, a fiber-filled resin, a composite material, and an elastomeric outer coating covering a semi-rigid metal inner cylindrical core or spring core. As illustrated, the transmission line 20 may comprise a coaxial cable that is fed through a lower opening 25 in the mast 24, through the hollow core (e.g., generally cylindrical hollow chamber), and the upper opening 27 in the mast 24 for electrical and mechanical connection to the antenna 30. The lower opening 25 and the upper opening 27 in the mast 24 communicate with the hollow core to retain and allow the transmission line 20 to be routed through the hollow core of the mast 24. The lower end of the transmission line 20 may terminate in a coaxial cable connector 22 for example. The transmission line 20 may be held captive by the central hollow core of the mast 24. Although the mast 24 has a hollow core as shown in FIG. 1 to receive the transmission line 20, in an alternate embodiment the mast 24 may have a solid core and the transmission line 20 may be secured to an outside of the mast 24 (e.g., via clamps, connectors, cable ties).

In one embodiment, the antenna 30 comprises a monopole antenna 30, with or without a ground plane. In an alternative embodiment, the antenna 30 may comprise a dipole element. In yet another alternative embodiment, the antenna 30 comprises a co-linear array of stacked monopole or dipole elements. In still another alternative embodiment, the antenna 30 comprises a yagi antenna or corner reflector antenna.

As illustrated, the dielectric guard 28 (e.g., lateral dielectric guard) comprises a generally conical member. Although the conical member has a larger radius or diameter of the conical member facing upward in FIG. 1, the conical member may also be oriented such that the larger radius or diameter of the conical member faces downward for improved removal or drainage of ice, snow, or precipitation. The guard 28 may be molded from any lightweight plastic material with adequate resistance to ultraviolet radiation and adequate impact resistance, such as polyethylene with an ultraviolet inhibiter or polymethyacrylate, for instance.

Figure 2:
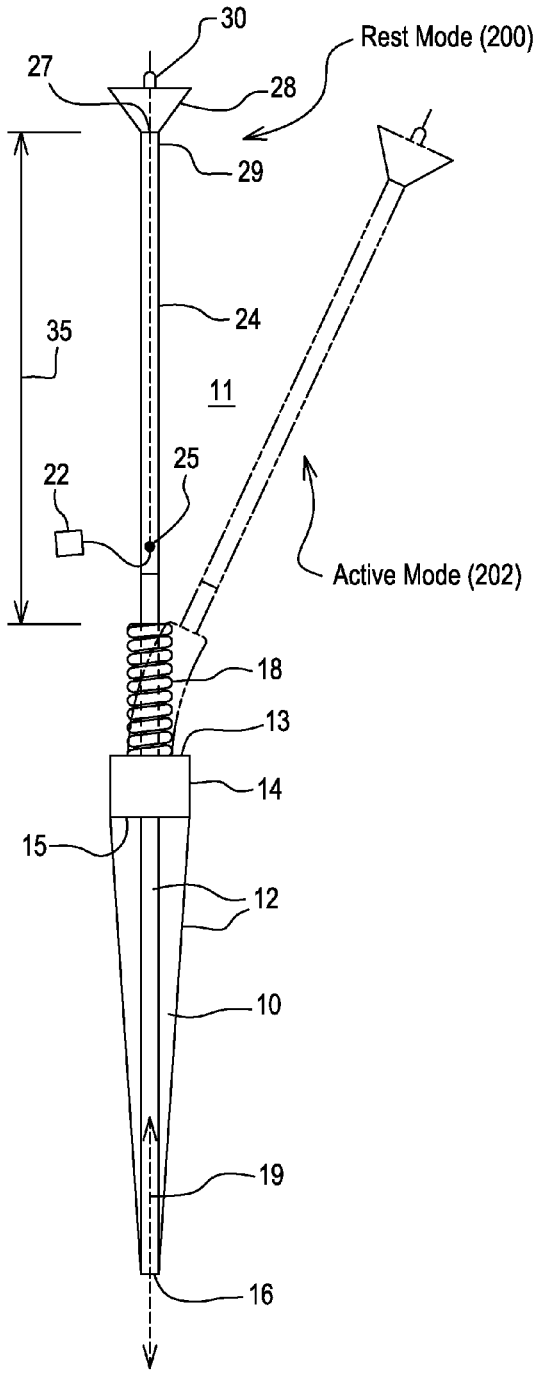
FIG. 2 illustrates a side view of the antenna system in a rest mode and in an active mode, where the rest mode is shown in solid lines and the active mode is shown in phantom or dashed lines.

FIG. 2 illustrates the operation of the antenna 30 of FIG. 1. Like reference numbers in FIG. 1 and FIG. 2 indicate like elements.

FIG. 2 illustrates the antenna 30 in a rest mode 200, which is shown in solid lines, and in an active mode 202, which is shown in dashed lines or in phantom. In the rest mode 200, the spring 18, mast 24, and antenna (e.g., 30, 130) are oriented generally vertically with respect to the ground. In the rest mode 200, the spring 18 is oriented orthogonal to the upper side 13 of the base 14 and the spring 18 has a lateral resilience, or spring constant, capable of supporting the mass of the mast 24, antenna 30, and dielectric guard 28 in a substantially vertical manner with respect to the ground. In an active mode 202, which is mutually exclusive to the rest mode 200, the dielectric guard 28 or mast 24 is contacted by a vehicle or machine with greater than a threshold force. In the active mode 202, the spring lateral resilience, or spring constant, is configured to allow the mast 24 to move resiliently with respect to the base 14, without any material permanent deformation of the spring 18.

In one embodiment, in the rest mode 200 the spring 18 is oriented generally orthogonal to the upper side of the base 14, and the spring 18 has a lateral resilience and vertical resilience, or an equivalent spring constant, capable of supporting the mass of the mast 24, antenna 30, and dielectric guard 28 in a substantially vertical manner with respect to the ground. In the active mode 202, when the dielectric guard 28 or mast 24 is contacted by a vehicle or machine with greater than a threshold force, the spring lateral resilience and vertical resilience (of spring 18) is configured to allow the mast 24 to move resiliently with respect to the base 14, without permanent deformation of the spring 18.

In any active mode 202, the antenna system (11, 111 or 211) dissipates or dampens the mechanical energy from the contact of the vehicle or machine to return to the rest mode 200 (without material permanent deformation of the spring) where the mast 24, antenna (30 or 130), and dielectric guard (28, 128 or 228) in a substantially vertical manner with respect to the ground.

Figure 3:
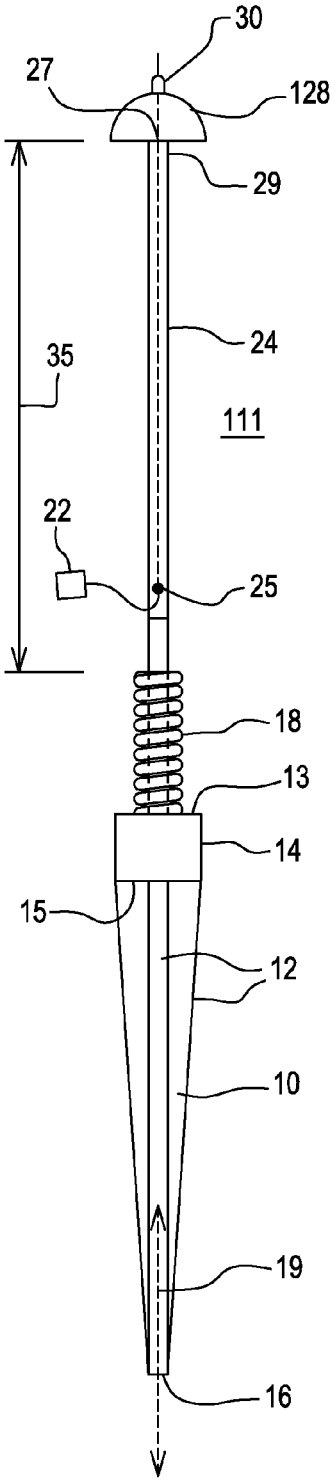
FIG. 3 illustrates a side view of another embodiment of an antenna system in accordance with the invention.

FIG. 3 shows an alternative embodiment of the antenna system 111. Like reference numbers in FIG. 1 and FIG. 3 indicate like elements. The antenna system 111 of FIG. 3 is substantially similar to the antenna system 11 of FIG. 1, except the generally conical dielectric guard 28 is replaced with a generally hemispherical dielectric guard 128. The hemispherical dielectric guard 128 may be oriented with its opening (or its larger radius) facing upward or downward. As shown in FIG. 3, the opening or larger radius of the hemispherical dielectric guard is facing down, for example. The antenna system 111 has a rest mode and an active mode similar to that of the antenna system 11.

Figure 4:
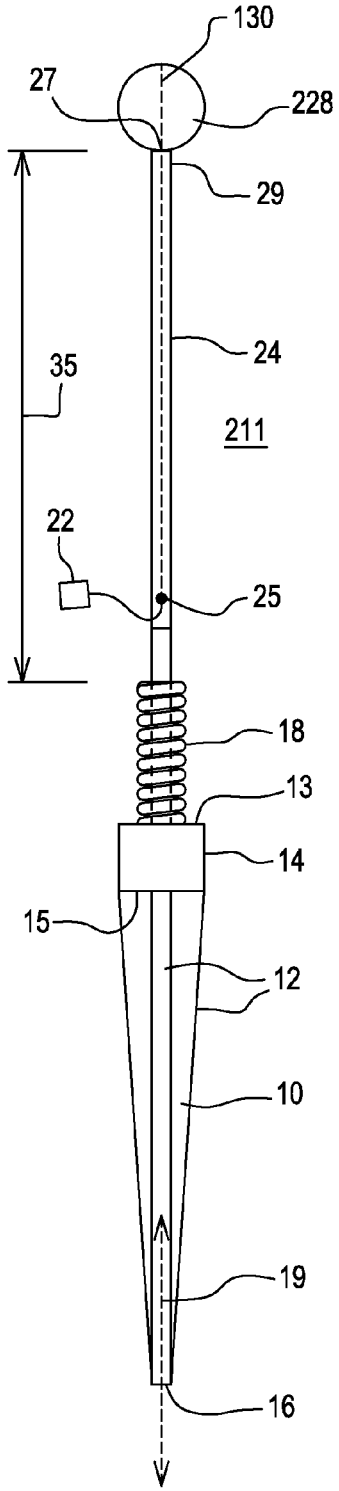
FIG. 4 illustrates a side view of yet another embodiment of an antenna system in accordance with the invention.

FIG. 4 shows an alternative embodiment of the antenna system 211. Like reference numbers in FIG. 1 and FIG. 4 indicate like elements. The antenna system 211 of FIG. 4 is substantially similar to the antenna system 11 of FIG. 1, except the generally conical dielectric guard 28 is replaced with a generally spherical dielectric guard 228. Further, the antenna (30 or 130) may be placed inside the dielectric spherical guard 228 to protect the antenna 130 from damage from the agricultural equipment or vehicle and to protect the antenna 130 from rain, dust, chemicals (e.g., agricultural chemicals, pesticides, fungicides, fertilizers), salt, ice and precipitation. The antenna system 111 has a rest mode and an active mode similar to that of the antenna system 11.

A transceiver, transmitter, receiver, sensor station, or other wireless station may be connected to the antenna 30 via the transmission line 20 and its connector 22. For example, the wireless station may comprise a cellular communications device, a satellite communications device, a two-way mobile radio, a paging receiver, a trunking radio, a code-division, multiple-access communications device, a time division-multiple, access-communications device, a transceiver in a mesh network, a point-to-point communications link, a point-to-multipoint communications system, a telemetry system, or a wireless local area network. The wireless station may be housed in a weatherproof, moisture-proof enclosure, salt-fog resistant, or hermetically sealed enclosure, such as a suitable National Electrical Manufacturers Association (NEMA) standards- compliant enclosure mounted at or near the base 14 of the antenna 30.

Any embodiments of the antenna system (11, 111, 211) disclosed in this document are well-suited for placement in an agricultural field where the boom of a sprayer or other agricultural equipment might strike the dielectric guard 28 or the mast 24. Accordingly, in an active mode 202 the antenna system (11, 111, 211) resiliently deflects downward when contacted by the boom or other agricultural equipment and then later returns to a rest mode 200 where the mast 24 is maintained in a generally vertical position with respect to the base 14 and the surface of the ground. The antenna system (11, 111, 211) is well-suited for placing the antenna (30 or 130) above the crop canopy or maximum crop height to avoid attenuation of the transmitted or received signal from the crop, among other things such as the surrounding terrain or other obstructions. The antenna system (11, 111, 211) facilitates reliable communications between one or more stations located in the field and a remote or central location of the grower, agronomist, or manager of the agricultural or other work operation.

Having described the preferred embodiment, it will become apparent that various modifications can be made without departing from the scope of the invention as defined in the accompanying claims.

The invention claimed is:

1. An antenna system for use in an agricultural field or work area, the antenna system comprising:

a base having an upper side and a lower side opposite the upper side;

a stake extending from the lower side, the stake capable of mounting into ground;

a spring extending from the upper side of the base;

a mast above the base movably, resiliently mounted to the base by the spring;

a lateral dielectric guard mounted at or the near the a top of the mast; and an antenna associated with the top of the mast, the antenna coupled to a transmission line comprising a coaxial cable that is secured to the mast and held captive within a central hollow core of the mast.

2. The antenna system according to claim 1 wherein the antenna comprises one or more of the following: a monopole antenna element, dipole antenna element, and a collinear array of antenna elements.

3. The antenna system according to claim 1 wherein the stake comprises at least one blade extending radially from a central vertical axis of the stake, the at least one blade tapered radially inward toward a bottom of the stake.

4. The antenna system according to claim 1 wherein the stake comprises a plurality blades extending orthogonally and radially from a central vertical axis of the stake, the blades tapered radially inward toward a bottom of the stake.

5. The antenna system according to claim 1 wherein the spring is oriented generally orthogonal to the upper side of the base, the spring having a lateral resilience capable of supporting a mass of the mast, antenna, and dielectric guard in a substantially vertical manner with respect to the ground in a rest mode, while in an active mode, when the dielectric guard or mast is contacted by an vehicle or machine with greater than a threshold force, the spring lateral resilience is configured to allow the mast to move resiliently with respect to the base.

6. The antenna system according to claim 1 wherein the spring is oriented generally orthogonal to the upper side of the base, the spring having a lateral resilience and vertical resilience capable of supporting a mass of the mast, antenna, and dielectric guard in a substantially vertical manner with respect to the ground in a rest mode, while in an active mode, when the dielectric guard or mast is contacted by an vehicle or machine with greater than a threshold force, the spring lateral resilience and vertical resilience is configured to allow the mast to move resiliently with respect to the base.

7. The antenna system according to claim 6 wherein in the active mode the antenna dissipates or dampens the mechanical energy from the contact of the vehicle or machine to return to the rest mode without material permanent deformation of the spring where the mast, antenna, and dielectric guard in a substantially vertical manner with respect to the ground.

8. The antenna system according to claim 1 wherein the mast comprises a rod composed of a polymer, a plastic, a resin, a fiber-filled polymer, a fiber-filled plastic, a fiber-filled resin, a composite material, and an elastomeric outer coating covering a semi-rigid metal inner cylindrical core or spring core.

9. The antenna system according to claim 1 wherein the dielectric guard comprises a generally conical member.

10. The antenna system according to claim 1 wherein the dielectric guard is generally hemispherical or generally spherical.

11. The antenna system according to claim 1 wherein the hollow core comprises a generally hollow chamber along its vertical axis and wherein the transmission line is routed through the hollow chamber at least between the spring and the antenna.

12. The antenna system according to claim 1 wherein the antenna extends above the lateral dielectric guard.

* * * * *